United States Patent [19]

Porter

[11] 4,276,106

[45] Jun. 30, 1981

[54] LAYING ORIENTED FIBROUS WEBS

[75] Inventor: Kenneth Porter, Harrogate, England

[73] Assignee: Imperial Chemical Industries Limited, London, England

[21] Appl. No.: 96,298

[22] Filed: Nov. 21, 1979

[30] Foreign Application Priority Data

Aug. 15, 1979 [GB] United Kingdom ..... 28435/79

[51] Int. Cl.[3] ..... D04H 3/04; D04H 3/10; D04H 3/12

[52] U.S. Cl. ..... 156/181; 19/299; 28/289; 156/290; 156/441

[58] Field of Search ..... 156/181, 180, 177, 430, 156/440, 441, 436, 596, 167, 285, 290; 226/97; 19/299, 65 T; 112/440, 762, 412; 28/100, 101, 102, 289

[56] References Cited

U.S. PATENT DOCUMENTS

| | | | |
|---|---|---|---|
| 2,622,306 | 12/1952 | Anderson | 28/100 |
| 2,622,306 | 12/1952 | Anderson | 28/100 |
| 3,293,718 | 12/1966 | Sheets | 28/101 |
| 3,293,718 | 12/1966 | Sheets | 28/101 |
| 3,460,731 | 8/1969 | Troth, Jr. | 19/299 |
| 3,488,819 | 1/1970 | Jackson | 28/100 |
| 3,488,819 | 1/1970 | Jackson | 28/100 |
| 3,511,625 | 5/1970 | Pitt | 19/299 |
| 3,511,625 | 5/1970 | Pitt | 19/299 |
| 3,563,838 | 2/1971 | Edwards | 156/181 |
| 3,766,606 | 10/1973 | Piper et al. | 28/283 |

FOREIGN PATENT DOCUMENTS

| | | |
|---|---|---|
| 292178 | 8/1971 | Austria . |
| 2421401 | 8/1977 | Fed. Rep. of Germany . |
| 48-11795 | 4/1973 | Japan . |
| 50-07178 | 3/1975 | Japan . |
| 1244753 | 9/1971 | United Kingdom . |
| 1244754 | 9/1971 | United Kingdom . |
| 1314588 | 4/1973 | United Kingdom . |
| 1341998 | 12/1973 | United Kingdom . |

*Primary Examiner*—Michael W. Ball
*Attorney, Agent, or Firm*—Cushman, Darby & Cushman

[57] ABSTRACT

An apparatus for laying down a fibrous strand in an ordered configuration comprises means for supplying a fibrous strand, means for forwarding the strand, means to impart an oscillatory motion to the forwarding strand and a moveable collecting surface whereon the strand is laid, the improvement being that the apparatus includes two closely spaced shaped plates which extend between the oscillating means and the collecting surface.

9 Claims, 9 Drawing Figures

1
2
3
4
5
6
7
8
9
10
11
12
13
14
15
16
17

1
4
9
10
11
12
13
14
16
17

LAYING ORIENTED FIBROUS WEBS

This invention relates to the production of fibrous webs having a high degree of orientation of the fibrous strands forming the web, comprising forwarding a strand towards a collecting surface and imparting an oscillatory motion to the strand at a point above the collecting surface.

Fibrous webs have been made from staple fibres by carding or by random air laying processes, the former process imparting some degree of isotropic arrangement of the fibres. Fibrous webs have also been made by collecting a mat of synthetic continuous filaments in which the filaments are more or less randomly intermingled in the mat. However in order that a fabric made from one or more webs should have properties which resemble more closely the properties of conventional woven or knitted fabrics it is considered desirable to introduce a high degree of orientation of the fibrous material comprising the web, as for example a high degree of parallelism in staple fibre yarns or filamentary strands oriented in for example, the machine or cross directions or in both these directions. Methods which have been proposed for introducing the desired orientation into a web of filamentary strands includes those in which the extruded multifilamentary strands are forwarded and drawn by means of air jets and the issuing filaments are given an oscillatory motion before freely falling onto a collecting brattice or support. U.K. Pat. Specification 1,244,753 described such a method wherein gas oscillating jets are applied to already drawn filaments. It has also been proposed in Japanese Pat. Publication 75 007 178 to oscillate the outlet of the forwarding jet to impart the desired oscillatory motion to the emerging filaments. These methods have not in practice proved entirely satisfactory in producing webs of as high a degree of parallelism and order as desired. Thus it is an object of this invention to provide a method in which movement of a strand in the laying down of a web is more fully controlled so as to approach more nearly the desired high degree of parallelism and order.

In U.S. Patent application Ser. No. 951,953 we have described a process for the production of an ordered web from at least one fibrous strand, comprising forwarding a strand towards a collecting surface, imparting an oscillatory motion to the strand at a point above the collecting surface, the strand being passed between two closely spaced planar plates which are substantially parallel to each other and to the plane of strand oscillation, the plates extending from the place of oscillation down to the collecting surface. The strand is laid in substantially straight lines on the collecting surface, successive lengths of strand being laid substantially parallel to previous lengths of strand.

We have now found that in such a process, significant advantage is achieved by using shaped rather than planar plates because this allows the strand to be laid in a predetermined, non-linear but still ordered, configuration on the collecting surface.

According to the present invention we provide a process for the production of an ordered web from at least one fibrous strand, comprising forwarding a strand towards a moving collecting surface and imparting an oscillatory motion to the strand at a position above the collecting surface, characterised in that the oscillating strand is passed between two closely spaced shaped plates which extend substantially from the place of oscillation down to the collecting surface whereon the strand is laid on the collecting surface in a non-linear configuration, the strand being substantially equally spaced along its length from a preceding length of strand.

Also according to the invention an apparatus for laying down a fibrous strand in an ordered configuration comprises means for supplying a fibrous strand, means for forwarding the strand, means to impart an oscillatory motion to the forwarding strand and a moveable collecting surface whereon the strand is laid, characterised in that the apparatus includes two closely spaced shaped plates which extend between the oscillating means and the collecting surface.

The spaced plates used will usually have a complementary shape so that, across the width of the plates, the plates will be substantially the same distance apart.

The plates may have any suitable shape including a curvilinear, for example sinusoidal corrugation, shape, a zig-zag shape, a castellated shape or some other shape which serves to lay the strand in a patterned arrangement on the collecting surface.

If desired the plates may have the same shape throughout their height. Alternatively the plates may have two or more different shapes at different heights, the different shapes merging into one another. In one embodiment an upper portion of each plate is planar and a lower portion has a corrugated for example zig-zag or sinusoidal, shape, the two portions merging into one another.

The term "closely spaced" is used herein to mean less than 75 mm.

The plates used may be uniformly spaced apart throughout their height by a distance of between 0.5 mm and 75 mm. Preferably, however, the plates are spaced apart by a distance of between 1 mm and 10 mm and more preferably are spaced apart by a distance of between 2 mm and 5 mm.

We prefer that the plates are arranged so that the space between them converges in a downward direction. Typically the spacing at the upper end of the plates is selected in the range 2 mm to 75 mm and at the lower end of the plates in the range 0.5 mm to 10 mm, as for example from a spacing at the upper end of 4 mm to a spacing of 2 mm at the lower end. This convergence of the space assists the wideways exhaust of air and reduces the possible disturbance of strands on the collector.

Likewise the distance between the lower ends of the plates and the collector is minimised consistent with maximising the efficiency and precision of laying that is to say so as to give maximum control of the strand while it is moving and immediately after it is laid. For higher strand speeds and web widths the function of the plates becomes increasingly important.

It is preferred to use a continuous filamentary strand in the present invention since these may be produced directly from a synthetic polymeric substance as for example by melt spinning. Staple fibre strands, preferably having only a low degree of twist, may also be used and the term "fibrous strand" as used herein includes both these and similar materials.

In producing a multifilamentary strand by melt extrusion of a synthetic polymer it is desirable to draw or orient the filaments to improve their strength and other physical properties. This may be done by forwarding the freshly extruded filaments at a high speed such that when they have cooled sufficiently any further drawing down of the still plastic filaments will cause orientation and alignment of the polymer chains which is set in on further cooling of the filaments to a temperature below the glass transition point. A gas forwarding jet is a convenient means to forward the strand and to produce this orientation. Means to impart an oscillatory motion to the strand may also utilise a compressed gas. Thus jets may be located on opposite sides of the forwarding jet outlet and operated alternately so as to direct the issuing strand first in one direction and then in the opposite direction. Alternatively a single intermittently operated jet may be used to impart the oscillatory motion.

A single or two port rotary valve may be conveniently used to provide the alternate or intermittent operation of the two jets or the single jet and the speed of rotation of this valve provides a simple control over the amplitude of oscillation described by the strand; the rotation speed bearing an inverse relationship to the strand amplitude when other conditions are constant. Thus the length of the courses of the strand laid on the collecting surface may be set within at least the range 0.5–4 m by adjustment of rotary valve speed particularly because the use of closely spaced plates between the oscillating jets and the collecting surface allows changes to have their full effect on strand movement. Oscillating jets may have a single orifice or number of orifices in line or preferably a narrow slot for exit of the compressed gas. It is preferred to mount the deflecting jets so that both the angle between the jets, if two are used, and the angle of the or each jet in relation to the issuing strand may be adjusted as a further means of controlling strand oscillation.

While deflecting gas jets are preferred, other devices may be used to impart oscillation to a strand provided they can induce a sufficiently large amplitude of oscillation at the collecting surface. Such alternative devices may be rotating or oscillating opposed pairs of coanda surfaces which are alternately brought into contact with the issuing strand.

Forwarding jets are well known in the art consisting of entry and exit passages for the strand and means to introduce the forwarding gas. The exit passage may be convergent or divergent but it is preferred to use a parallel passage to maintain the integrity of the issuing strand passing to the place of oscillation.

We have found that when closely spaced shaped plates are provided between the forwarding/oscillating means and the collecting surface the strand will assume a non-planar wave form oscillation the amplitude of which may increase in successive half waves from the place of oscillation up to a value dependent upon the forces involved and will maintain this non-planar motion until it reaches the collecting surface whereon it is laid in substantially equally spaced courses having a patterned arrangement which is dependent on the shape of the plates used. It is preferred that the height of the plates above the collecting surface is about the same as the distance required to establish the first crest in the waveform oscillation or the maximum amplitude if an oscillation of this kind is established. The plates should extend as close to the place of oscillation and as close to the collecting surface as is practicable so that maximum control of the falling strand is maintained.

The laying of strands on the collecting means may be conducted with a very high precision to produce a web of substantially uniform thickness particularly when several strand laying devices are to be used together to produce a single or multi-layer web. Furthermore a variety of webs can be produced by using in sequence a number of pairs of differently shaped plates.

It is preferred to produce webs by moving the collecting surface away from the laying position at a speed related to the speed of strand laying in a direction either transverse to or parallel to the direction of laying. The former direction produces a web with transverse strand courses analagous to the weft of a woven fabric. However it will be realised that because the strands are laid in non-straight lines across the collecting surface they will provide the web simultaneously with a component in the warp direction which has not been achieved in a satisfactory manner previously. It will be realised that such a web, because it has a component in both the warp and weft directions, will exhibit unidirectional properties desirable in fabrics for use as apparel textiles. When the collecting surface is moved in a direction parallel to the direction of laying then successive bands of what may be termed warp wise strand courses are produced. However because these strands will have a component in both the warp and weft directions a final web exhibiting two directional properties which as mentioned above is desirable in fabrics for use as apparel textiles.

Webs made according to this invention require to be bonded in some manner to convert them into useful fabrics and for this purpose it is preferred to use some form of segmental or spot bonding method so as to preserve the directional properties introduced in making the web. It is further preferred to include in the web at least a proportion of thermoplastic filaments or fibres and to employ a thermal segmental bonding method for making the final fabric. Such segmental bonding methods are described in for example U.K. Patent Specifications 1,245,088, 1,474,101 and 1,474,102. Thermoplastic synthetic filaments or fibres of many kinds are suitable for use in this invention either alone or in admixture with natural or other non-thermoplastic fibres. It is most preferred that the webs include or are composed of bicomponent synthetic fibres in which one of the components present at least in part at the surface of the fibre or filament is of lower softening or melting point, than the other and forms a strong bond under suitable conditions of heat and pressure. Alternatively or in addition to the foregoing segmental or spot bonding methods other processes may be used as for example, stitch bonding in which the web is held together by chains of stitching using a separate thread or part of the web itself and machinery which is capable of operating at fast production rates.

Synthetic polymeric filamentary strands being non-conductors and hydrophobic tend to accumulate static charges when in frictional contact with processing surfaces and as such charges may disturb the even oscillation or laying of a falling strand care is necessary to eliminate or reduce the accumulation of such charges by the provision of static discharging means at or near the point of oscillation or by surface treatment of the filaments with an appropriate chemical agent.

It is preferred, when using a gas forwarding jet, that a small amount of the issuing gas is allowed to pass in a gentle current down between the plates to assist the passage of an oscillating strand down to the collecting surface. It is also preferred that the collecting surface is a pervious brattice to allow escape of gas and if necessary the application of suction to the under side at the place of contact with a newly laid strand and thus to ensure its complete contact with the brattice.

The accompanying drawings illustrate the invention and one manner in which it may be performed using compressed gas both for transport and for oscillation of a strand.

Figure 1:
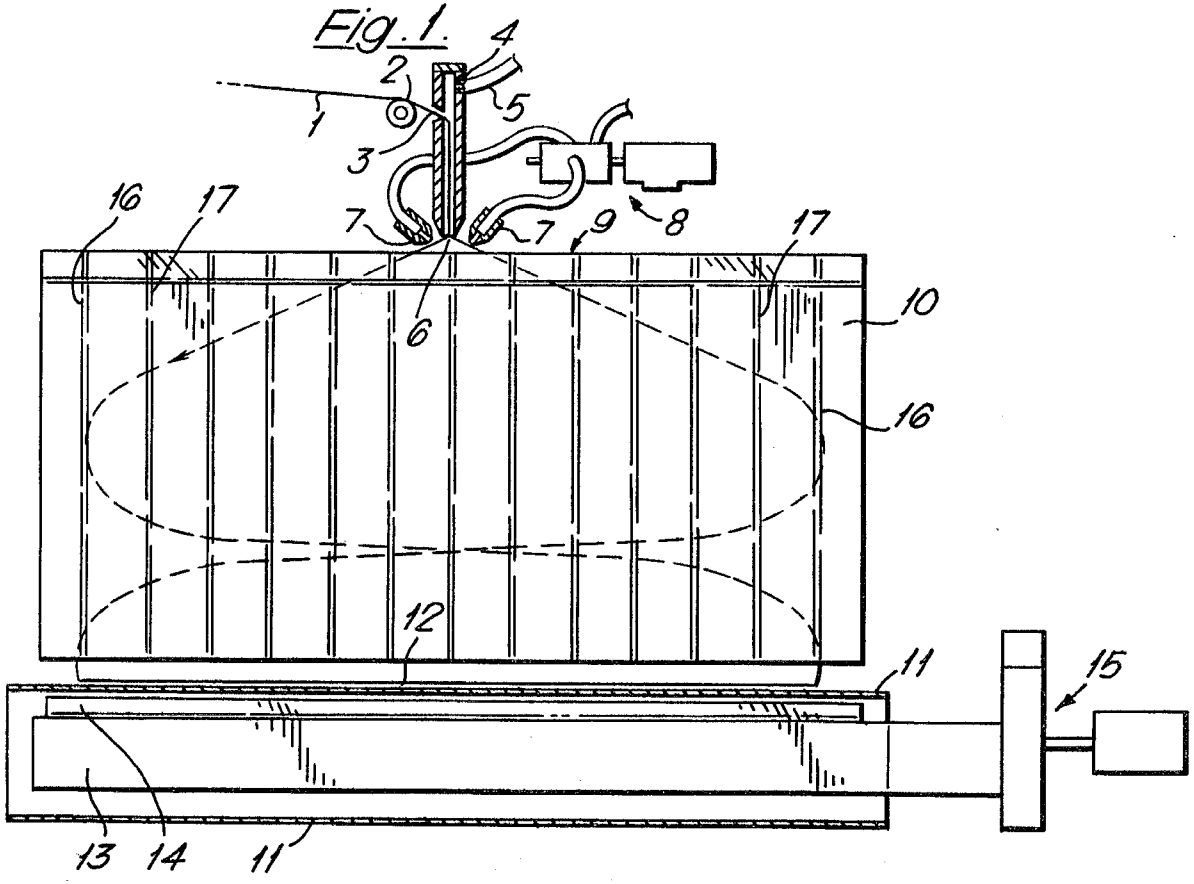
FIG. 1 is a front elevation of an apparatus in which a strand is being laid transversely onto a foraminous conveyor and FIG. 2 is a side elevation of the apparatus of FIG. 1.
Figure 2:
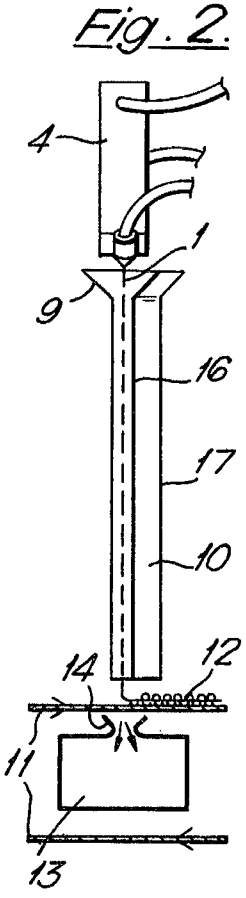
Figure 3:
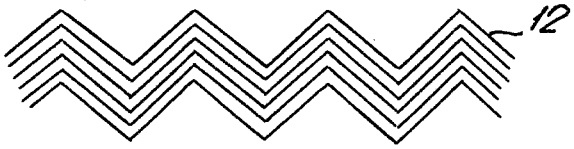
FIG. 3 illustrates the pattern in which the strand is laid on the collecting surface using the apparatus depicted in FIG. 1 and FIG. 2.

Referring to FIG. 1 a strand 1 is led by way of a small tension roll 2 into the entry 3 of a forwarding jet 4 which is supplied with compressed gas from a supply port 5 above the strand entry 3. The gas tensions the yarn forwards it to the outlet 6 close to which on either side are positioned deflection jets 7 which are alternately supplied with pulses of gas from a motorised rotary valve 8. The strand 1 falls from the jet outlet 6 into the convergent entry 9 of two zig-zag shaped plates 10 having crests 16 and troughs 17 closely spaced apart and arranged transversely and close to an endless foraminous conveyor 11. Gas jets 7 alternately are directed against the emerging strand 1 moving it to the left and then to the right and causing it to oscillate and to assume a sinuous path as it falls between plates 10. As the strand 1 passes between the plates 10 the initial motion imparted by the deflection jets 7 develops to its full extent until at the level of the conveyor 11 the strand has moved out to the full desired width and is then laid down on the conveyor in successive courses 12 across the conveyor. Also as the strand 1 passes between the plates it is caused to follow the path defined by the two zig-zag plates so that the strand is laid down on the conveyor in a zig-zag manner as illustrated in FIG. 3. To assist the regular and complete laying of each strand on the conveyor an exhaust duct 13 is positioned beneath the conveyor 11 and is provided with a narrow slot inlet 14 arranged close to the underside of the conveyor and immediately below the lower edges of plates 10. A fan 15 provides at the inlet 14 suction to draw the strands against the conveyor surface.

In FIG. 1 left and right moving lengths of strand 1 are shown moving in somewhat idealised fashion between plates 10 as solid and broken lines respectively. Examination of the apparatus illustrated in the drawings in the operating condition by means of stroboscopic illumination through a transparent plate 10 shows that the strand takes up a uniform path the form of which alters with changes in forwarding and oscillating speeds.

The plates 10 serve to control and stabilise the movement of the oscillating strand. The width of the plates in the direction of oscillation should be at least equal to and is preferably just a little wider than the maximum width of web to be laid. As described above the height of the plates depends upon the laying conditions used and the form of the strand path established.

Figure 4:
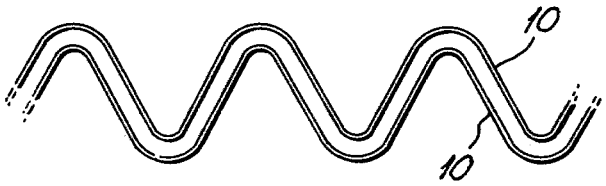
FIG. 4 is a plan view of a different shaped pair of plates.

FIG. 4 shows a plan view of a pair of plates 10 having a shape in the form of a sinusoidal corrugation.

Figure 5:
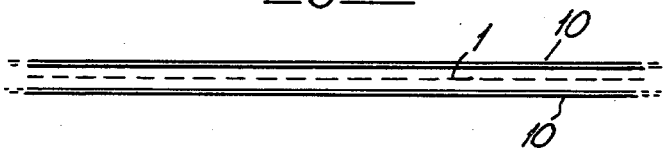
FIG. 5 is a plan view, from above, of another pair of shaped plates.
Figure 6:
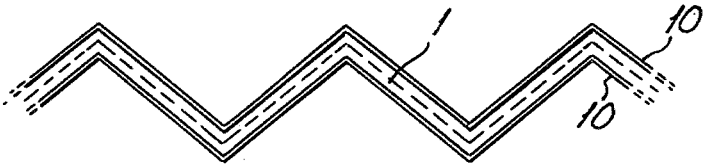
FIG. 6 is a plan view, from below, of the pair of shaped plates shown in FIG. 5.
Figure 7:
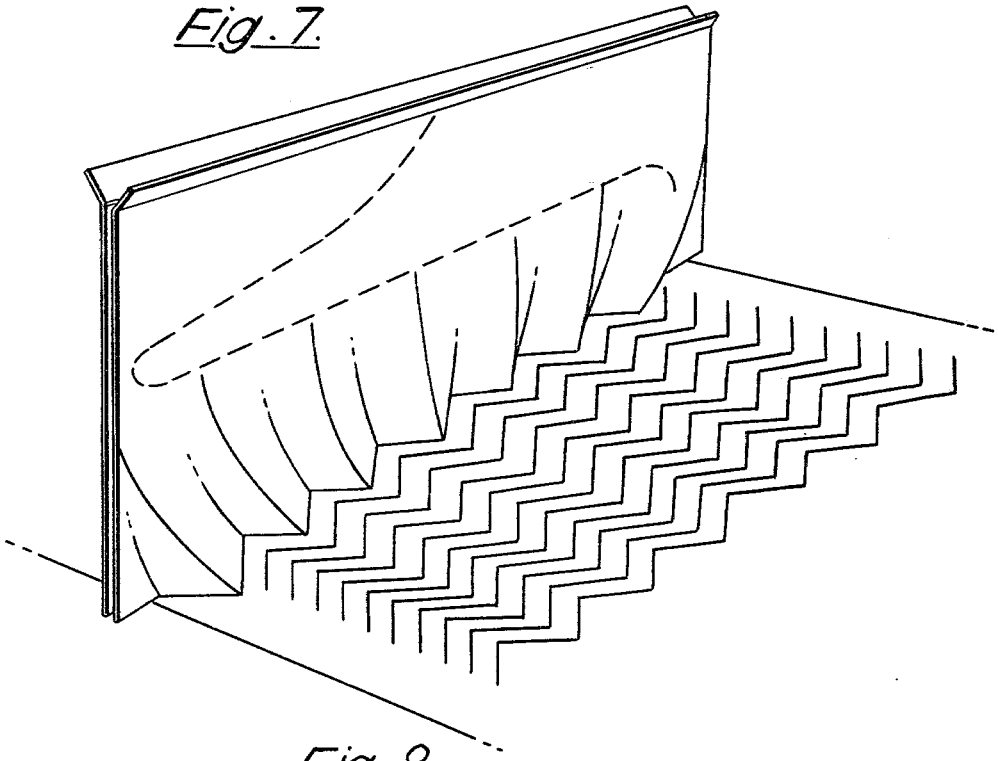
FIG. 7 is an elevation of the shaped plates illustrated in FIGS. 5 and 6 in relation to the collecting surface and showing, diagrammatically, the strand as it is laid down on the collecting surface.

FIGS. 5, 6 and 7 illustrate another pair of plates 10 in which an upper portion, adjacent to the jet outlet 6, has a planar shape and a lower portion, adjacent to the collecting means, having a shape resembling a sinusoidal corrugation. The pair of plates depicted in FIGS. 5, 6 and 7 will also have an intermediate portion (not shown in FIGS. 5 and 6 but shown in FIG. 7) in which the planar portion merges with the corrugated portion. With plates of this type, the strand 1 (identified with a broken line) when entering the space between the plates will adopt a linear shape. Eventually, however, as the strand proceeds down the plates it will adopt a shape corresponding to the shape of the space between the plates at their lower end (see FIG. 6 and 7).

Figure 8:
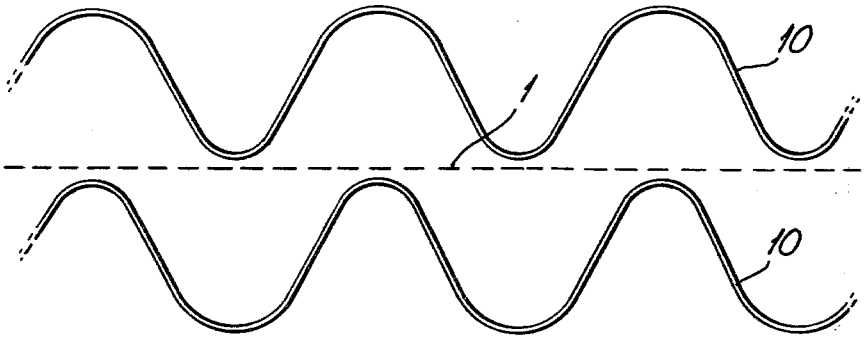
FIG. 8 is a plan view, from above, of yet another pair of shaped plates.
Figure 9:
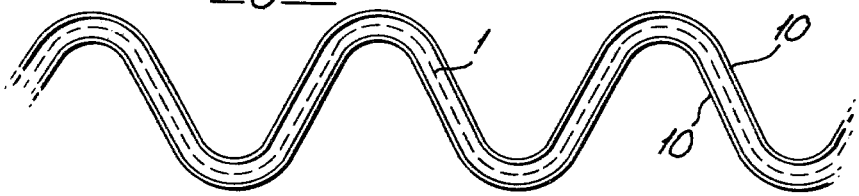
FIG. 9 is a plan view, from below, of the pair of shaped plates shown in FIG. 8.

FIGS. 8 and 9 illustrate yet another pair of plates 10 having a shape in the form of a sinusoidal corrugation, the space between the plates converging downwards in such a manner that at the upper end of the plates (see FIG. 8) the crests on one of the plates are not located within the troughs on the other plate so that the strand 1 (identified with a broken line) entering the space between the plates can adopt a linear rather than curvilinear shape. Eventually however as the strand reaches the bottom of the plates it will have adopted a curvilinear shape.

The invention will now be described by way of the following Example.

EXAMPLE

A strand composed of 60 synthetic filaments and with a final decitex of 200, spun direct from a spinneret, was led by way of rolls rotating at a surface speed of 3650 m/min to the entry of a forwarding jet supplied with compressed air at a pressure of 1758 g/cm$^2$ gauge. A motorised rotary valve, supplied with compressed air at a pressure of 5625 g/cm$^2$ gauge gave impulses of compressed air to each of two deflector jets fitted immediately below the forwarding jet and symmetrically in relation thereto at an included angle of 165° between the jets. Each deflector jet received compressed air from the rotary valve for 50% of the valve revolution. The rotary valve rotated at a speed of 2,000 rpm.

The strand emerging from the forwarding/deflecting device was passed between a pair of corrugated metal plates 0.50 m high and 0.95 m wide. The corrugations running from the top to the bottom of each identical plate were such that equi-length 'legs' met at right angles, the 'leg' length being 6.9 cm. The plates were set up below the forwarding/deflecting device and were so arranged at an angle to each other and to the vertical that the corrugations intermeshed at the bottom of the plates to give a gap width of 3 mm between apices whilst at the top the corrugations did not mesh and an apex gap of 66 mm was obtained.

The tops of the plates were 1.5cm above a horizontally disposed foraminous conveyor running at right angles to the width direction of the plates. Suction was applied below the exit from the plates. A highly ordered web of filaments about 68 cm wide was formed consisting of closely spaced uniform zig-zags with each 'leg' at about 45° to the direction of the conveyor movement.

I claim:

1. A process for the production of an ordered web from at least one fibrous strand, comprising forwarding a strand towards a moving collecting surface and imparting an oscillatory motion to the strand at a position above the collecting surface, the improvement being that the oscillating strand is passed between two closely spaced shaped plates which extend substantially from the place of oscillation down to the collecting surface whereon the strand is laid on the collecting surface in non-linear parallel courses, the strand being substantially equally spaced along its length from a preceding length of strand, said plates being substantially parallel to one another and to the plane of oscillation of the strands except for surface irregularities producing the non-linear shape of the parallel courses.

2. A process as claimed in claim 1 in which the ordered web is segmentally or spot bonded.

3. A process as claimed in claim 1 in which the ordered web is stitch bonded.

4. An apparatus for laying down a fibrous strand in non-linear, parallel courses comprising means for supplying a fibrous strand, means for forwarding the strand, means to impart an oscillatory motion to the forwarding strand and a moveable collecting surface whereon the strand is laid, the improvement being that the apparatus includes two closely spaced shaped plates which extend between the oscillating means and the collecting surface, said plates being substantially parallel to one another and to the plane of oscillation of the strands except for surface irregularities producing the non-linear shape of the parallel courses.

5. An apparatus as claimed in claim 4 in which both of the plates have a curvilinear shape, a zig-zag shape or a castellated shape.

6. An apparatus as claimed in claim 4 in which both of the plates have two or more different shapes at differing heights above the collecting surface, the different shapes merging into one another.

7. An apparatus as claimed in claim 6 in which both of the plates have an upper portion having a planar shape and a lower portion having a corrugated shape.

8. An apparatus as claimed in claim 4 in which the plates are so arranged that the space between them converges in a downward direction.

9. An apparatus as claimed in claim 8 in which the space between the plates at their upper end is selected in the range 2 mm to 75 mm and at their lower end is selected in the range 0.5 mm to 10 mm.

* * * * *